United States Patent [19]

Walker

[11] Patent Number: 4,930,657

[45] Date of Patent: Jun. 5, 1990

[54] FLOTABLE DRAIN PLUG

[76] Inventor: William T. Walker, 28 Tamela Dr., Little Rock, Ark. 72207

[21] Appl. No.: 281,330

[22] Filed: Dec. 8, 1988

[51] Int. Cl.[5] ..... B65D 53/00

[52] U.S. Cl. ..... 220/235; 220/238; 215/359; 215/360; 114/197; 264/6

[58] Field of Search ..... 220/233, 235, 236, 237, 220/238; 215/359, 360, 361; 4/286, 287, 295; 138/89; 264/6, 42; 114/197, 198

[56] References Cited

U.S. PATENT DOCUMENTS

| | | | |
|---|---|---|---|
| 1,455,978 | 5/1923 | Wentz | 215/360 X |
| 2,321,515 | 6/1943 | Rice | 215/359 X |
| 2,479,862 | 8/1949 | Payne | 215/359 |
| 2,672,999 | 3/1954 | Protasoff | 215/359 X |
| 2,729,353 | 1/1956 | Moeller | 215/359 |
| 2,822,108 | 2/1958 | Moeller | 220/238 |
| 2,978,138 | 4/1961 | Moeller | 220/235 |
| 3,295,712 | 1/1967 | Peterson | 220/235 |
| 3,430,777 | 3/1969 | Esposito, Jr. | 215/361 X |
| 3,674,055 | 7/1972 | Ray | 220/233 X |
| 3,812,810 | 5/1974 | Moeller | 215/360 X |
| 3,859,945 | 1/1975 | Moeller | 215/359 X |
| 4,759,462 | 7/1988 | Neglio | 220/235 |

*Primary Examiner*—Stephen Marcus
*Assistant Examiner*—Nova Stucker
*Attorney, Agent, or Firm*—Leonard Bloom

[57] ABSTRACT

A drain plug, which has a hollow cylindrical body, an expander assembly within the body and a manually manipulatable handle, is fabricated of a material such that the drain plug floats. The handle is connected to the expander assembly and when the handle is moved in a cam or rotational movement, the expander assembly is moved axially within the body. This axial movement expands the body of the drain plug such that the drain plug closes the drain opening and contracts the body of the drain plug for ease of removal from the drain opening. The expander assembly seals the end of the body and is secured within the body so it does not move when the handle is rotated.

25 Claims, 3 Drawing Sheets

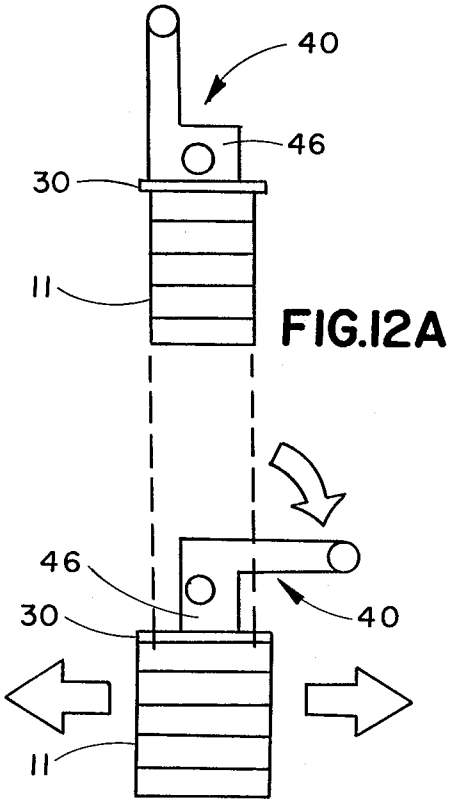
FIG.12A
FIG.12B
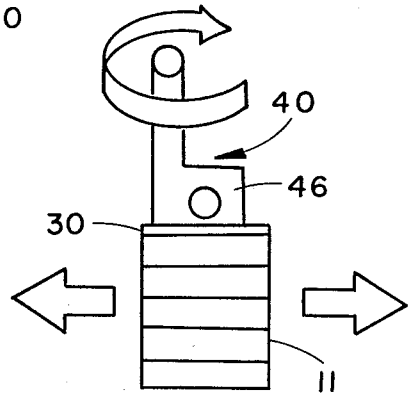
FIG.13
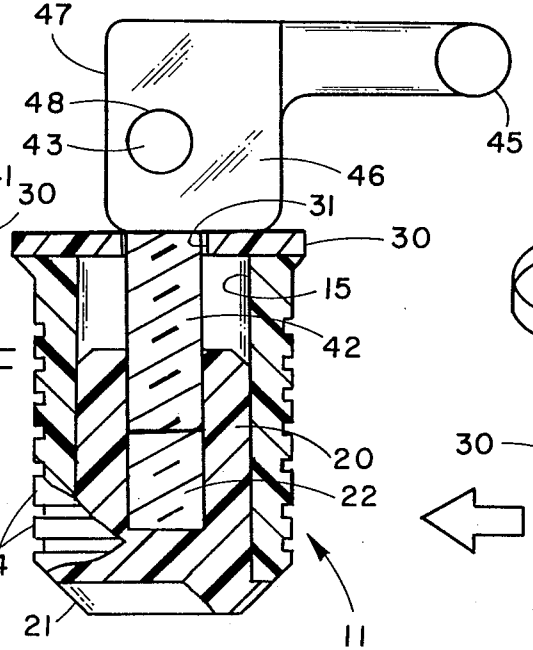
FIG.11
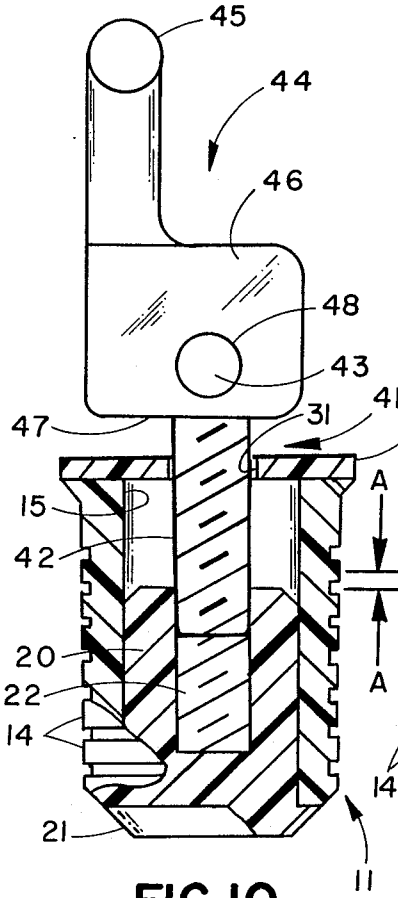
FIG.10

FLOTABLE DRAIN PLUG

FIELD OF THE INVENTION

The present invention relates to a drain plug which may be inserted in a drain opening and in particular to a floating drain plug which may be easily radially expanded and contracted to seal and unseal the drain opening.

BACKGROUND OF THE INVENTION

Drain plugs find use in a wide variety of applications. Household use in a sink or tub is well known, but drain plugs are also needed in industrial and marine applications. Small boats have drain openings below the water line and generally at the stern of the boat to allow drainage of water from inside the boat when the boat has been taken from the water for storage or maintenance. Depending on the design of the boat and the accessibility of the opening, it is frequently necessary to insert the drain plug from the outside of the boat. Some boats have wells inside the boat for fishermen to keep the live fish which they have caught and these live wells often have a drain opening with a drain plug inserted from within the boat. The use of drain plugs in boats introduce several unique problems. Traditional plugs are made in brass and aluminum which may be used in wooden, fiberglass or non-metallic boats. However, with aluminum boats, a dissimilar metal such as brass will cause corrosion of the boat. Furthermore, the traditional plugs, if loosened in the drain opening can easily be lost if fitted from the outside of the boat. In the live well it is difficult to locate the plug if in the bottom of dirty water. In either event, it is urgent that the plug be reinserted in the opening before water fills the boat and the boat sinks.

U.S. Pat. No. 2,199,964 discloses a stopper, intended primarily for household use, which has an outer body and an inner metallic cup-shaped expander which can be raised and lowered within the body by movement of a lever or a finger piece. U.S. Pat. No. 4,103,372 teaches a pop-up drain plug which is closed by pressing on a cover member to move a latch pin over a camming surface which activates a ball and spring. Release of the drain plug is also produced by pressure on the cover member. Despite these teachings, a need exists for an easily used drain plug which is non-metallic so as to avoid corrosion effects and which will float for rapid retrieval. In addition, the drain plug must be easily and inexpensively manufactured.

SUMMARY OF THE INVENTION

A principal object of the invention is to provide a drain plug which is easily inserted and removed from a drain opening, will prevent fluid from passing through the drain and will float in the fluid when released.

It is another object of the invention to provide a drain plug which has a radially expandable body which can be easily expanded or contracted by movement of a handle on the drain plug and will float in the fluid.

It is yet another object of the invention to provide a drain plug which is inexpensive, lightweight and easy to use.

It is yet another object of the invention to provide a drain plug with a body which is radially expandable by rotation of a handle connected to an expander assembly within the body, wherein the expander assembly is secured within the body and does not move when the handle is rotated.

It is still another object of the invention to provide a method for fabricating a non-metallic, inexpensive, lightweight drain plug.

In accordance with the teachings of the present invention, there is disclosed a drain plug which includes a radially expandable, hollow cylindrical body having an upper end and a lower end. An expander assembly is disposed within the hollow body which also seals the lower end of the body. A manually manipulatable handle is connected to the expander assembly; the handle extends outwardly from the upper end of the body. A means is provided for radially expanding and contracting the body, such that the drain plug may be inserted into a drain opening to conform to the drain opening. The body may be radially expanded so that fluid is prevented from passing through the drain opening. The drain plug may be radially contracted and easily removed from the drain opening. The drain plug is fabricated of a material such that the drain plug floats to the surface of the fluid when the plug is released in the fluid. Preferably, the material has a specific gravity of less than one so that the plug will float in water.

In a preferred embodiment, the drain plug includes a radially expandable, hollow cylindrical body having an upper end and a lower end. The body may be tapered; the upper end of the body having a diameter greater than the diameter of the lower end of the body. The cylindrical body has an outer surface which has a plurality of parallel ridges circumferentially thereabout. An expander assembly is disposed within the hollow body which also seals the lower end of the body. The seal between the body of the plug and the expander assembly comprises a disc attached to the expander assembly. The disc is disposed outwardly from the lower end of the body and has a diameter smaller than the lower end of the body. A manually manipulatable handle is connected to the expander assembly; the handle extends outwardly from the upper end of the body. A means is provided for radially expanding and contracting the body such that the drain plug may be inserted into a drain opening to conform to the drain opening. The body may be radially expanded so that fluid is prevented from passing through the drain opening. The drain plug may be radially contracted and easily removed from the drain opening. The handle has a post member and an arm member. The post member has a first end threadably connected to the expander assembly and a second end extending outwardly from the upper end of the body. The arm member has a first end with a cam surface. The first end is pivotally connected to the second end of the post member. The arm member has a "T" shaped second end for manual manipulation. Movement of the arm member in a first rotational direction or a first pivotal cam direction moves the expander assembly in a first axial direction thereby radially expanding the body to seal the drain opening. Movement of the arm member in a second rotational direction or a second pivotal cam direction moves the expander assembly in a second opposite axial direction. This movement radially contracts the body so the drain plug may be easily removed from the drain opening. The drain plug is fabricated of a material such that the drain plug floats to the surface of the fluid when the drain plug is released in the fluid. The drain plug includes a washer which has a circular opening in the center thereof. The post member is inserted therethrough. The washer has a diameter greater than the upper end of the body such that the washer is adjacent to the upper end of the body.

The second end of the post member further has two cylindrical protuberances, each extending perpendicularly outwardly from opposite sides of the post. The first end of the arm member further carries a pair of spaced-apart ears each having a cam surface. Each ear also has a circular opening therein. The second end of the post member is disposed between the two ears such that the cylindrical protuberances on the post member are complementary to, and engage the circular openings in the ears. In this manner, the arm member may pivot about the post member and against the washer. The handle may be threadably adjusted to vary the spacing between the cam ears and the washer such that movement of the arm in a first pivotal cam direction varies the extent of axial movement of the expander assembly and also varies the amount of radial expansion of the body.

The cylindrical body of the drain plug has an inner surface, which has a plurality of inwardly extending parallel ribs extending between the upper end and the lower end of the body. The expander assembly has an outer surface, which has a plurality of parallel grooves thereon. When the expander assembly is disposed within the hollow body, the ribs on the inner surface of the body cooperate with the grooves in the expander assembly. The expander assembly is securely held within the body when the handle is rotated and the body is radially expanded and contracted.

Viewed in another aspect the present invention provides a method of fabricating a drain plug. The method includes the step of mixing a thermoplastic rubber with air to produce a foam. The foam is molded to form a hollow cylindrical body having an upper end, a lower end, an outer surface and an inner surface. The inner surface has a plurality of inwardly extending parallel ribs extending between the upper end and the lower end. The outer surface has a plurality of parallel ridges circumferentially thereabout. A cylindrical plastic expander assembly is molded which has an upper end, a lower end and an outer surface. The upper end has a threaded opening therein. The lower end has a disc attached thereto. The disc has a diameter smaller than the diameter of the lower end of the body. The outer surface of the expander assembly has a plurality of grooves thereon such that when the expander assembly is disposed within the hollow body, the ribs on the inner surface of the body cooperate with the grooves in the expander assembly and the disc on the expander assembly seals the lower end of the body. A plastic washer is molded which has a circular opening in the center thereof.

A handle is molded which has a plastic post member and plastic arm member. The post member has a first end and a second end. The first end has threads which cooperate with the threaded opening in the plastic expander assembly. The second end of the post member has two cylindrical protuberances extending perpendicularly outwardly from opposite sides of the post. The arm member has a first end and a T-shaped second end. The first end of the arm member further carries a pair of spaced-apart ears. Each ear has a cam surface, and each ear has a circular opening therein. The handle is assembled while the arm member is hot by spreading the cam-shaped ears and inserting therebetween the second end of the post member. The cam-shaped ears are closed so the cylindrical protuberances on the post member are complementary to, and engage, the circular openings in the cam-shaped ears. The arm member is cooled to secure the arm member to the post member. The drain plug is assembled by inserting the upper end of the expander assembly into the lower end of the hollow body such that the ribs on the inner surface of the body cooperate with the grooves on the outer surface of the expander assembly. The disc on the lower end of the expander assembly is adjacent to the lower end of the body and seals the hollow body. The first end of the post member of the handle is inserted through the circular opening in the plastic washer. The first end of the post member is threadably connected with the threaded opening in the expander assembly. The handle is rotated to securely connect the handle to the expander assembly and the body.

These and other objects of the present invention will become apparent from a reading of the following specification, taken in conjunction with the enclosed drawings.

BRIEF DESCRIPTION OF THE DRAWINGS

FIG. 10 is a side elevation of the drain plug having a portion of the body broken away therefrom, showing the arm in a first cam direction and illustrating the expander assembly within the radially contracted body.

FIG. 11 is a side elevation of the drain plug having a portion of the body broken away therefrom showing the arm in a second cam direction and illustrating the expander assembly within the radially expanded body and showing the axial movement of the expander assembly.

FIG. 12A–12B are side elevations showing movement of the arm between the first and second cam directions and illustrating the radially expansion of the body.

FIG. 13 is a side elevation showing the alternate rotational movement of the arm and illustrating the radially expansion of the body.

DESCRIPTION OF THE PREFERRED EMBODIMENTS

Figure 3:
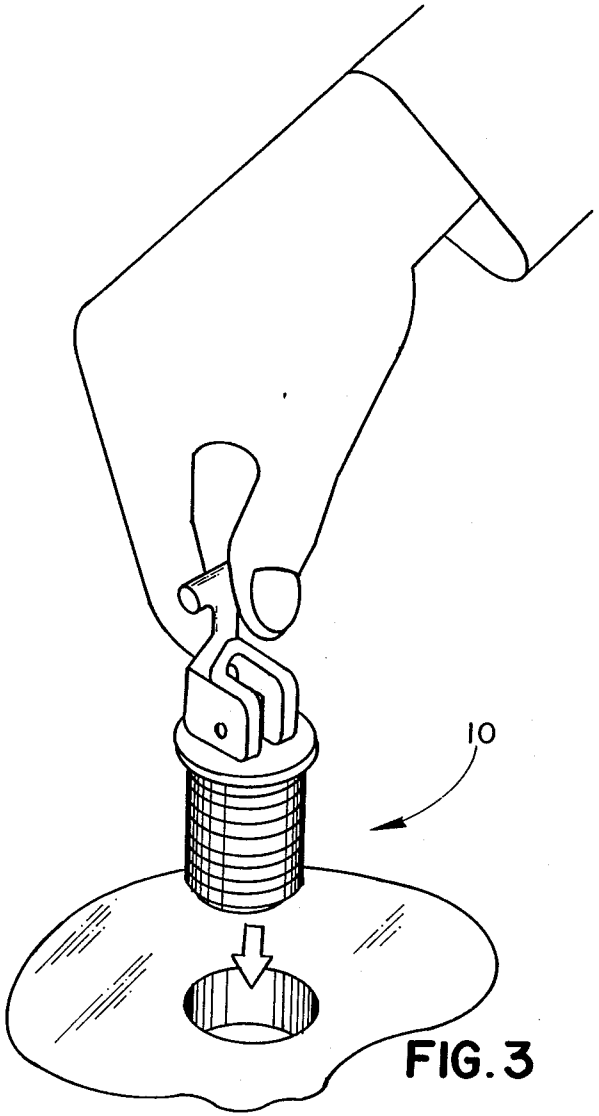
FIG. 3 is a perspective view showing manual placement of the drain plug in a drain opening.
Figure 2:
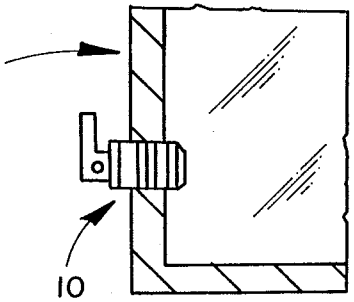
FIG. 2 is a cross-section taken along lines 2—2 of FIG. 1 showing the drain plug in the drain opening in the stern of the boat.
Figure 1:
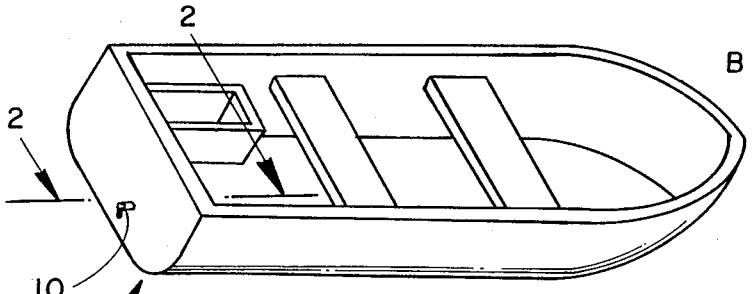
FIG. 1 is a perspective view of a typical application of the device in a boat.
Figure 5:
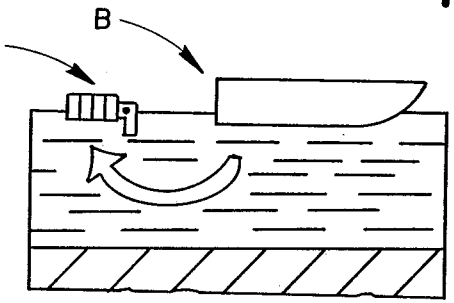
FIG. 5 is a perspective view showing the drain plug of the present invention (again, enlarged in scale) floating and retrievable after it becomes loose in the drain opening.
Figure 4:
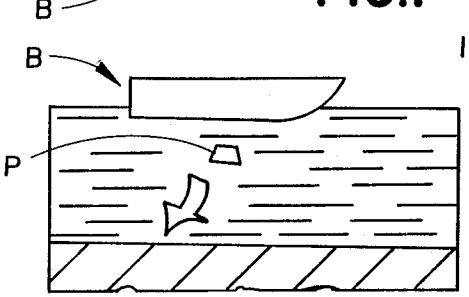
FIG. 4 (PRIOR ART)
FIG. 4 is a perspective view showing prior art in which the drain plug is lost if it becomes loose in the drain opening (the drain plug being enlarged in scale for clarity and ease of illustration).
Figure 7:
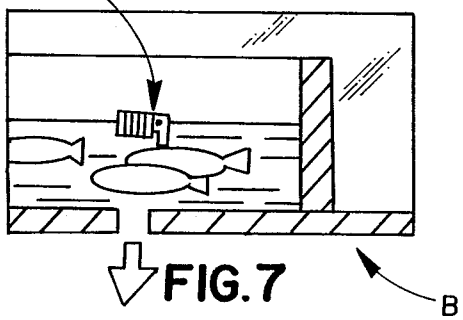
FIG. 7 is a perspective view of the drain plug floating in the live well aboard the boat.
Figure 6:
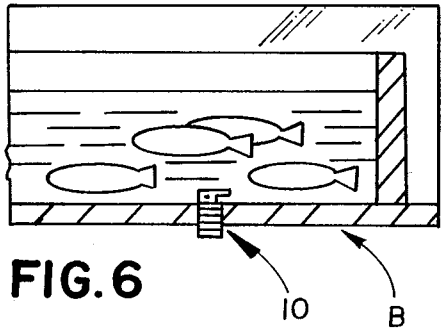
FIG. 6 is a perspective view of the drain plug in a live well having fish in the well aboard the boat.

Referring now to the drawings, FIGS. 1–7 show typical applications of the use of the drain plug 10 in a marine environment. The drain plug 10 commonly is inserted in the drain opening in the stern of the boat B from the outside of the boat because of difficulty in reaching the drain opening from the inside of the boat. In the event the drain plug were to become loosened in the drain opening or were improperly inserted into the opening, the prior art plug P would sink to the bottom of the lake or river (FIG. 4) and be lost. Consequently, the boat would fill with water and also sink. The drain plug 10 of the present invention floats to the surface (FIG. 5) where it can be readily retrieved and reinserted into the drain opening in the boat before the boat fills with water. In a similar manner, drain plugs in a live well within the boat become dislodged and water enters the boat. With fish and murky water in the well, the fisherman must grope for the drain plug to attempt to close the drain opening. The present invention floats to the surface so the drain opening may be closed rapidly before a significant amount of water enters the boat.

Figure 8:
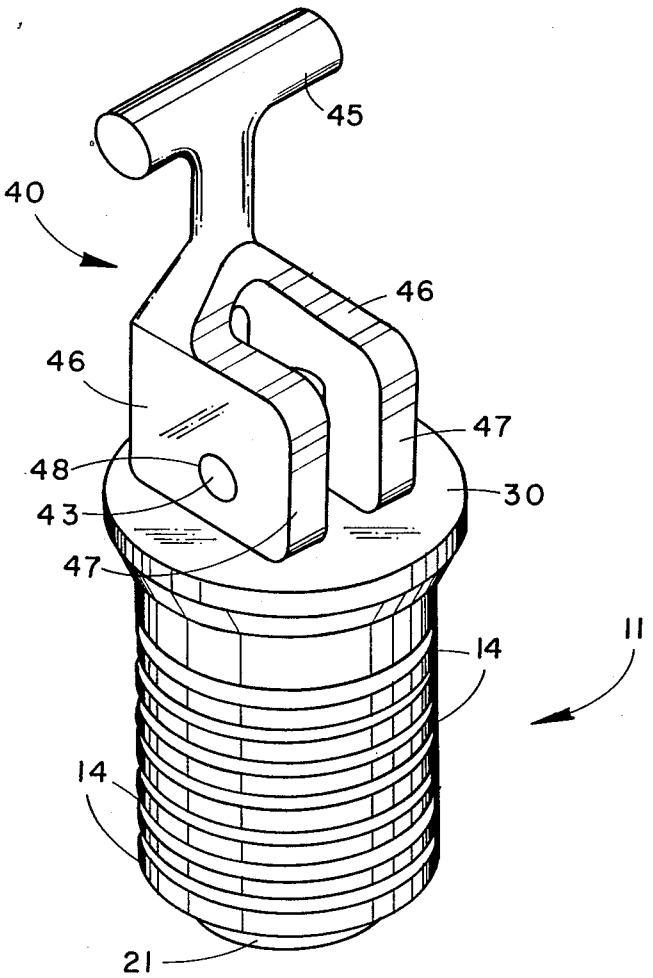
FIG. 8 is a perspective view of the drain plug of the present invention.

FIG. 8 shows the drain plug 10 having a cylindrical body 11, the upper end 12 of which is closed with a washer 30. A handle 40 is attached to the body 11.

Figure 9:
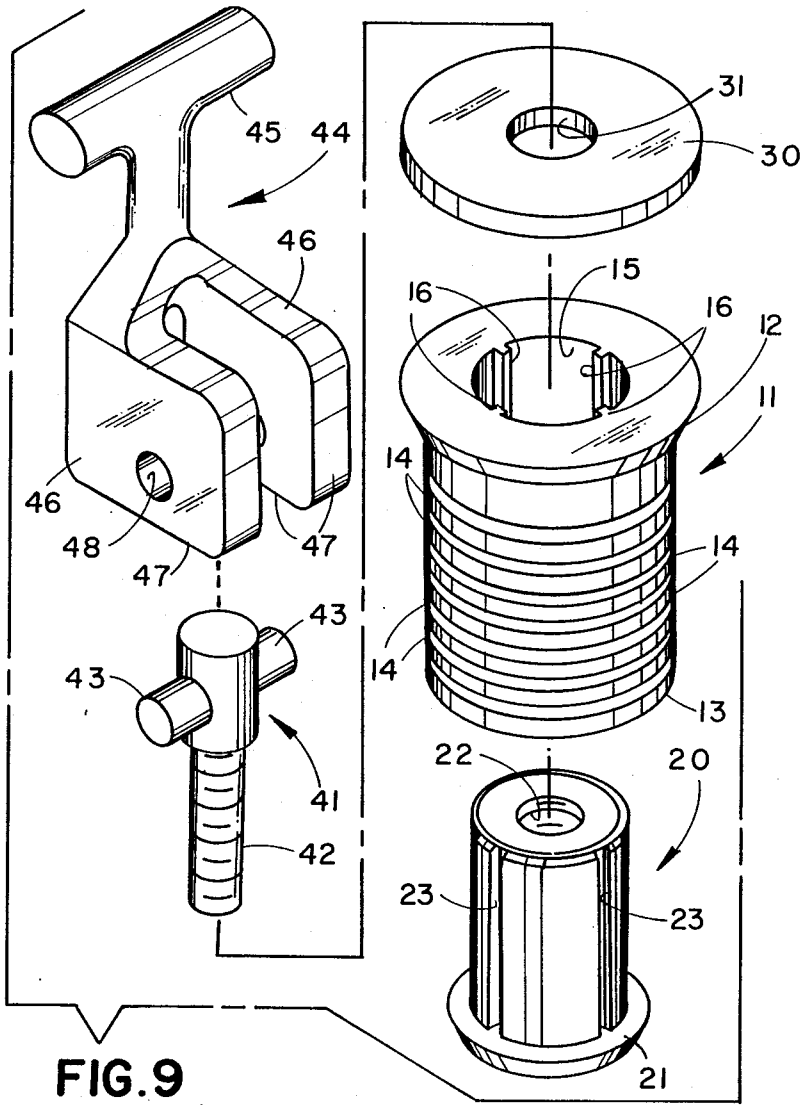
FIG. 9 is an exploded perspective view of the drain plug showing the members of the plug.

With reference to FIGS. 8 and 9, the hollow body 11 has an upper end 12 and a lower end 13. Circumferentially around the body 11 are a plurality of parallel ridges 14 to provide a positive seal to the drain opening. The inner surface of the body 15 has a plurality of inwardly extending parallel ribs 16 thereon, the ribs extend from the lower edge of the body 13 to the upper edge of the body 12. An expander assembly 20 is disposed within the body 11. The expander assembly 20 has a disc 21 attached to the end and disposed outwardly from the lower end of the body 13. The disc 21 seals the lower end of the body 13. The expander assembly 20 also has a threaded opening 22 in other end. The outer surface of the expander assembly 20 has a plurality of parallel grooves 23 which extend from the disc 21 to the opposite end of the expander assembly 20. The grooves 23 cooperate with the ribs 16 to securely hold the expander assembly 20 in the body 11. A washer 30 having an opening 31 in the center thereof closes the upper end of the body 12. The handle 40 is comprised of a post member 41 and an arm member 44. The post member 41 has a threaded end 42 which cooperates with the threads in the opening 22 of the expander assembly 20. The post member 41, which is inserted in opening in the washer 31 has a second end extending outwardly from the upper end of the body 12. The second end of the post member 41 has two cylindrical protuberances 43 extending perpendicularly outwardly from the post member 41. The first end of the arm member 44 is T-shaped 45. the second end of the arm member 44 carries a pair of spaced-apart ears 46, each of which has a cam surface 47 and a circular opening 48. The second end of the post member 41 is disposed between the ears 46. The cylindrical protuberances on the post member 43 complement and engage the circular openings 48 in the ears of the arm member 44 so that the arm member 44 may pivot thereabout. This eliminates pins and rivets which are commonly used and which may corrode.

FIGS. 10–12B illustrate the cam embodiment of the drain plug 10. The handle 40, in a first cam direction, is shown in FIG. 10. The body 11 is in a radially contracted position. When the handle 40 is pivotally moved about the circular protuberances 43 into a second cam direction (FIG. 11), the expander assembly 20 is moved in an axial direction toward the upper end 12 of the body 11. The extent of movement is shown by the dimension A—A. The resultant radial expansion of the body 11 is shown by the arrows in FIG. 12B and the extent of the expansion is illustrated by the broken lines between FIG. 12A and FIG. 12B. This expansion can be adjusted, if desired, by rotating the handle 40 to increase or decrease the distance between the cam surface 47 and the washer 30. The greater the distance, the less the cam action, and consequently, the less the radial expansion of the body 11. Reverse rotation produces greater radial expansion of the body 11. In this manner, the drain plug 10 may be fitted more securely or less securely in the drain opening and/or may be used with a drain opening which has an opening slightly different from the standard opening.

FIG. 13 illustrates the rotational embodiment of the drain plug 10. Movement of the handle 40 in a first rotational direction moves the expander assembly 20 in a first axial direction thereby radially expanding the body 11 to seal the drain opening. Moving the handle 40 in an opposite, second rotational direction moves the expander assembly 20 in a second opposite axial direction, thereby radially contracting the body 11 so the drain plug 10 may be removed from the drain opening.

It will be appreciated by those skilled in the art that the drain plug 10 may be fabricated with bodies 11 of the various diameters to be used with drain openings of corresponding diameters.

The ribs 16 in the body 11 which cooperate with the grooves 23 in the expander assembly 20, secure the body 11 to the expander assembly 20. Rotation of the expander assembly 20 is prevented when the handle 40 is rotated.

The drain plug 10 floats in the water and the preferred configuration is fabricated entirely of plastic. The body 11 is a thermoplastic rubber and the other parts are polypropylene, all having a density less than the density of water. Also, these materials do not corrode nor is there a metal to metal interaction. It will be appreciated that other plastics having the desired properties may be utilized in fabrication of the drain plug 10. The use of the molded components results in an inexpensive, easily fabricated plug which, because of its light weight, also reduces freight costs when shipped in bulk quantities.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A drain plug adapted to float on water wherein the plug is normally associated with a drain opening such that the drain plug floats to the surface of the water in the event that the drain plug becomes loose from the drain opening so that the drain plug may be retrieved conveniently, said drain plug comprising:

a radially expandable, hollow cylindrical body having an upper end and a lower end, the lower end of the body having an annular surface;

an expander assembly disposed within the hollow body, the expander assembly including a sleeve, the sleeve having an end portion having a unitary annular flange formed integrally thereon, the annular flange on the sleeve engaging the annular surface of the body thereby forming a seal with the lower end of the body;

a keying means between the sleeve and the hollow body to prevent rotation therebetween;

a manually manipulatable handle connected to the expander assembly, the handle extending outwardly from the upper end of the body;

means for radially expanding and contracting the body; including means for retracting the sleeve within the body such that the annular flange on the sleeve which engages the annular surface on the end of the body causes the body to axially contract while radially expanding the body;

such that when the drain plug is inserted into the drain opening, the body may be radially expanded to conform to the drain opening so that fluid is prevented from passing through the drain opening, and the drain plug may be radially contracted and easily removed from the drain opening.

2. The drain plug of claim 1, wherein the means for radially expanding and radially contracting the body comprises:

the handle having a post member and an arm member, the post member having a first end attached to the expander assembly and a second end extending outwardly from the upper end of the body; the arm member having a cam shaped first end pivotally connected to the second end of the post member and a second end for manual manipulation;

such that movement of the arm member in a first cam direction moves the expander assembly in a first axial direction thereby radially expanding the body to seal the drain opening, and movement of the arm member in a second direction moves the expander assembly in a second opposite axial direction thereby radially contracting the body so the drain plug may be easily removed from the drain opening.

3. The drain plug of claim 1, wherein the means for radially expanding and contracting the body comprises:

the handle having a post member and an arm member, the post member having a first end threadably connected to the expander assembly and a second end extending outwardly from the upper end of the body, the arm member connected to the second end of the post member;

such that rotation of the arm member in a first direction rotates the post member and moves the expander assembly in a first axial direction thereby radially expanding the body to seal the drain opening, and rotation of the arm member in a second direction rotates the post member in a second direction and moves the expander assembly in a second opposite axial direction thereby radially contracting the body so the drain plug may be easily removed from the drain opening.

4. The drain plug of claim 1, wherein the handle is T-shaped.

5. The drain plug of claim 1, wherein the body is tapered, the upper end of the body having a diameter greater than the lower end of the body.

6. The drain plug of claim 1, wherein the plug is fabricated of non-metallic material.

7. The drain plug of claim 1, wherein the cylindrical body has an outer surface, the outer surface having a plurality of parallel ridges circumferentially thereabout.

8. The drain plug of claim 1, wherein the handle is threadably connected to the expander assembly.

9. The drain plug of claim 1, wherein the seal between the body of the plug and the expander assembly comprises a disc attached to the expander assembly, the disc disposed outwardly from the lower end of the body and having a diameter smaller than the lower end of the body.

10. A drain plug adapted to float on water wherein the plug is normally associated with a drain opening such that the drain plug floats to the surface of the water in the event that the drain plug becomes loose from the drain opening so that the drain plug may be retrieved conveniently, comprising:

a radially expandable, hollow cylindrical body having an upper end and a lower end, the lower end of the body having an annular surface;

an expander assembly disposed within the hollow body, the expander assembly including a sleeve, the sleeve having an end portion having a unitary annular flare formed integrally thereon, the annular flange on the sleeve engaging the annular surface of the body thereby forming a seal wtih the lower end of the body;

a keying means between the sleeve and the hollow body to prevent rotation therebetween;

a manually manipulatable handle connected to the expander assembly, the handle extending outwardly from the upper end of the body including means for retracting the sleeve within the body such that the annular flange on the sleeve which engages the annular surface on the end of the body causes the body to axially contract while radially expanding the body;

such that the drain plug may be inserted into a drain opening to conform to the drain opening, and the body may be radially expanded so that fluid is prevented from passing through the drain opening, and such that the drain plug may be radially contracted and easily removed from the drain opening;

the handle having a post member and an arm member, the post member having a first end threadably connected to the expander assembly and a second end extending outwardly from the upper end of the body, the arm member having a first end with a cam surface, the first end pivotally connected to the second end of the post member and a "T" shaped second end for a manual manipulation; and such that movement of the arm member in a first rotational direction or a first pivotal cam direction moves the expander assembly in a first axial direction thereby radially expanding the body to seal the drain opening, and movement of the arm member in a second rotational direction or a second pivotal cam direction moves the expander assembly in a second opposite axial direction, thereby radially contracting the body so the drain plug may be easily removed from the drain opening.

11. The drain plug of claim 10, further comprising:

a washer having a circular opening in the center thereof, the post member inserted therethrough, the washer having a diameter greater than the upper end of the body such that the washer is adjacent to the upper end of the body;

the second end of the post member further having two cylindrical protuberances, each extending perpendicularly outwardly from opposite sides of the post;

the first end of the arm member further carrying a pair of spaced-apart ears each having a cam surface, each ear having a circular opening therein;

the second end of the post member disposed between the two ears such that the cylindrical protuberances on the post member are complementary to, and engage the circular openings in the ears whereby the arm member may pivot thereabout against the washer; and such that the handle may be threadably adjusted to vary the spacing between the cam ears and the washer such that movement of the arm in a first pivotal cam direction varies the extent of axial movement of the expander assembly and also varies the amount of radial expansion of the body.

12. The drain plug of claim 10, wherein the cylindrical body has an outer surface, the outer surface having a plurality of parallel ridges circumferentially thereabout.

13. The drain plug of claim 10, wherein the handle is threadably connected to the expander assembly.

14. The drain plug of claim 10, wherein the seal between the body of the plug and the expander assembly comprises a disc attached to the expander assembly, the disc disposed outwardly from the lower end of the body and having a diameter smaller than the lower end of the body.

15. A drain plug comprising:

a material of fabrication such that the drain plug floats to the surface of a fluid when released in the fluid;

a radially expandable, hollow cylindrical body having an upper end and a lower end;

an expander assembly disposed within the hollow body and sealing the lower end of the body;

a manually manipulatable handle connected to the expander assembly, the handle extending outwardly from the upper end of the body;

such that the drain plug may be inserted into a drain opening to conform to the drain opening, and the body may be radially expanded so that fluid is prevented from passing through the drain opening, and such that the drain plug may be radially contracted and easily removed from the drain opening;

the handle having a post member and an arm member, the post member having a first end threadably connected to the expander assembly and a second end extending outwardly from the upper end of the body, the arm member having a first end with a cam surface, the first end pivotally connected to the second end of the post member and a "T" shaped second end for manual manipulation;

such that movement of the arm member in a first rotational direction or a first pivotal cam direction moves the expander assembly in a first axial direction thereby radially expanding the body to seal the drain opening, and movement of the arm member in a second rotational direction or a second pivotal cam direction moves the expander assembly in a second opposite axial direction, thereby radially contracting the body so the drain plug may be easily removed from the drain opening;

wherein the cylindrical body has an inner surface, the inner surface further having a plurality of inwardly extending parallel ribs extending between the upper end and the lower end;

the expander assembly having an outer surface, the outer surface further having a plurality of parallel grooves thereon;

such that when the expander assembly is disposed within the hollow body, the ribs on the inner surface of the body cooperate with the grooves in the expander assembly; and such that the expander assembly is securely held within the body when the handle is rotated and the body is radially expanded and contracted.

16. A drain plug comprising:

a material of fabrication such that the drain plug floats to the surface of a fluid when released in the fluid;

a radially expandable hollow cylindrical body having an upper end and a lower end, the upper end having a diameter greater than the lower end;

an expander assembly disposed within the hollow body, a disc attached to the expander assembly, the disc disposed outwardly from the lower end of the body and having a diameter smaller than the lower end of the body to seal the lower end of the body;

a manually manipulatable handle connected to the expander assembly, the handle extending outwardly from the upper end of the body;

such that the drain plug may be inserted into a drain opening to conform to the drain opening and the body may be radially expanded so that fluid is prevented from passing through the drain opening, and such that the drain plug may be radially contracted and easily removed from the drain opening;

the handle having a post member and an arm member, the post member having a first end threadably connected to the expander assembly and a second end extending outwardly from the upper end of the body;

a washer having a circular opening in the center thereof, the post member inserted therethrough, the washer having a diameter greater than the upper end of the body such that the washer is adjacent to the upper end of the body;

the second end of the post member further having two cylindrical protuberances, each extending perpendicularly outwardly from opposite sides of the post;

the arm member having a first end and a T-shaped second end, the first end of the arm member further carrying a pair of spaced-apart ears each having a cam surface, each ear having a circular opening therein;

the second end of the post member disposed between the two ears such that the cylindrical protuberances in the post member are complementary to, and engage the circular openings in the ears whereby the arm member may pivot thereabout against the washer;

such that movement of the arm member in a first rotational direction or a first pivotal cam direction moves the expander assembly in a first axial direction thereby radially expanding the body to seal the drain opening and movement of the arm member in a second rotational direction or a second pivotal cam direction moves the expander assembly in a second opposite axial direction thereby radially contracting the body so the drain plug may be easily removed from the drain opening;

such that the handle may be threadably adjusted to vary the spacing between the cam ears and the washer such that movement of the arm in a first pivotal cam direction varies the extent of axial movement of the expander assembly and also varies the amount of radial expansion of the body;

the cylindrical body having an inner surface, the inner surface further having a plurality of inwardly extending parallel ribs extending between the upper end and the lower end;

the expander assembly having an outer surface, the outer surface further having a plurality of parallel grooves thereon;

such that when the expander assembly is disposed within the hollow body, the ribs on the inner surface of the body cooperate with the grooves in the expander assembly; and such that the expander assembly is securely held within the body when the handle is rotated and the body is radially expanded and contracted.

17. In a drain plug for a boat and other applications, wherein the drain plug has a body portion that may be expanded radially to seat the drain plug in an aperture in the boat, the improvement wherein the drain plug is substantially integrally molded from a plastic material, such that the drain plug has a specific gravity of less than one, and such that the drain plug will float to the surface of the water in the event that the drain plug becomes loose from its aperture, whereby the drain plug may be retrieved conveniently.

18. The improvement of claim 17, further including a manually-manipulatable handle pivotably mounted on the drain plug and connected to the body portion of the drain plug for radially expanding the body portion, wherein the handle may be either pivoted or rotated to expand the body portion of the drain plug.

19. A method of fabricating a floatable drain plug, the method comprising the steps of:

mixing a thermoplastic rubber with air to produce a foam, molding the foam to form a hollow cylindrical body having an upper end, a lower end, an outer surface and an inner surface, the inner surface having a plurality of inwardly extending parallel ribs extending between the upper end and the lower end, the outer surface having a plurality of parallel ridges circumferentially thereabout;

molding a cylindrical plastic expander assembly having an upper end, a lower end and an outer surface, the upper end having a threaded opening therein, the lower end having a disc attached thereto, the disc having a diameter smaller than the diameter of the lower end of the body, the outer surface having a plurality of grooves thereon such that the expander assembly may be disposed within the hollow body, the ribs on the inner surface of the body cooperating with the grooves in the expander assembly and the disc on the expander assembly sealing the lower end of the body;

molding a plastic washer having a circular opening in the center thereof;

molding a handle having a plastic post member and plastic arm member;

the post member having a first end and a second end, the first end having threads which cooperate with the threaded opening in the plastic expander assembly, the second end having two cylindrical protuberances extending perpendicularly outwardly from opposite sides of the post;

the arm member having a first end and a T-shaped second end, the first end of the arm member further carrying a pair of spaced-apart ears each having a cam surface, each ear having a circular opening therein;

assembling the handle while the arm member is hot by spreading the cam-shaped ears and inserting therebetween the second end of the post member, closing the cam-shaped ears so the cylindrical protuberances on the post member are complementary to, and engage, the circular openings in the cam-shaped ears and cooling the arm member to secure the arm member to the post member; and assembling the drain plug by inserting the upper end of the expander assembly into the lower end of the hollow body such that the ribs on the inner surface of the body cooperate with the grooves on the outer surface of the expander assembly, the disc on the lower end of the expander assembly being adjacent to the lower end of the body and sealing the hollow body, inserting the first end of the post member of the handle through the circular opening in the plastic washer, threadably connecting the first end of the post member with the threaded opening in the expander assembly and rotating the handle to securely connect the handle to the expander assembly and the body.

20. A drain plug for easy insertion in and removal from a drain plug comprising:

the drain plug being fabricated from a material having a specific gravity of less than one;

a radially expandable, substantially hollow cylindrical body having an upper end and a lower end, the lower end of the body having an annular surface;

a sleeve disposed in the body, the sleeve having a lower end having a unitary annular flange formed integrally thereon such that the annular flange on the sleeve engages the annular surface on lower end of the body and provides a seal therebetween;

a keying means between the sleeve and the body to prevent rotation therebetween;

a post member connected to the sleeve, the post member extending outwardly from the upper end of the body; and a manually manipulatable means for moving the post and sleeve upwardly to radially expand and axially compress the body to seal the drain opening and for moving the post and the sleeve downwardly to radially contract and axially expand the body to permit removal of the drain plug from the drain opening.

21. The drain plug of claim 20, wherein the cylindrical body has an inner surface, the inner surface further having a plurality of inwardly extending parallel ribs extending between the upper end and the lower end;

the sleeve having an outer surface, the outer surface further having a plurality of parallel grooves thereon;

such that when the sleeve is disposed within the hollow body, the ribs on the inner surface of the body cooperate with the grooves in the sleeve; and such that the sleeve is securely held within the body when the handle is rotated and the body is radially expanded and contracted.

22. The drain plug of claim 20, wherein the drain plug floats to the surface of a fluid when released in the fluid.

23. The drain plug of claim 20, wherein the manually manipulatable means comprises:

a handle having an arm member, the arm member having a cam shaped first end pivotally connected to the post member and a second end for manual manipulation; and such that movement of the arm member in a first cam direction moves the sleeve in a first axial direction thereby radially expanding the body to seal the drain opening, and movement of the arm member in a second cam direction moves the sleeve in a second opposite axial direction thereby radially contracting the body so the drain plug may be easily removed from the drain opening.

24. The drain plug of claim 20, wherein the manually manipulatable means comprises:

a handle having an arm member, the arm member being connected to the post member, the post member being threadably connected to the sleeve; and such that rotation of the arm member in a first direction rotates the post member and moves the sleeve in a first axial direction thereby radially expanding the body to seal the drain opening, and rotation on the arm member in a second direction rotates the post member in a second direction and the sleeve in a second opposite axial direction thereby radially contracting the body so the drain plug may be easily removed from the drain opening.

25. A drain plug for easy insertion in and removal from a drain plug comprising:

a radially expandable, substantially hollow cylindrical body having an upper end and a lower end;

a sleeve disposed in the body, the sleeve having a lower end having an annular flange thereon such that the annular flange engages the lower end of the body and provides a seal therebetween;

a keying means between the sleeve and the body to prevent rotation therebetween;

a post member connected to the sleeve, the post member extending outwardly from the upper end of the body;

a manually manipulatable means for moving the post and sleeve upwardly to radially expand and axially compress the body to seal the drain opening and for moving the post and the sleeve downwardly to radially contract and axially expand the body to permit removal of the drain plug from the drain opening;

the cylindrical body having an inner surface, the inner surface further having a plurality of inwardly extending parallel ribs extending between the upper end and the lower end;

the sleeve having an outer surface, the outer surface further having a plurality of parallel grooves thereon;

such that when the sleeve is disposed within the hollow body, the ribs on the inner surface of the body cooperate with the grooves in the sleeve;

such that the sleeve is securely held within the body when the handle is rotated and the body is radially expanded and contracted, wherein the drain plug floats to the surface of a fluid when released in the fluid;

a handle having an arm member, the arm member having a cam shaped first end pivotally connected to the post member and a second end for manual manipulation;

such that movement of the arm member in a first cam direction moves the sleeve in a first axial direction thereby radially expanding the body to seal the drain opening, and movement of the arm member in a second cam direction moves the sleeve in a second opposite axial direction thereby radially contracting the body so the drain plug may be easily removed from the drain opening; and the arm member further being connected to the post member, the post member being threadably connected to the sleeve such that rotation of the arm member in a first direction rotates the post member and moves the sleeve in a first axial direction thereby radially expanding the body to seal the drain opening, and rotation of the arm member in a second direction rotates the post member in a second direction and moves the sleeve in a second opposite axial direction thereby radially contracting the body so the drain plug may be easily removed from the drain opening.

* * * * *